US006588483B2

(12) United States Patent
Rosenberg

(10) Patent No.: US 6,588,483 B2
(45) Date of Patent: Jul. 8, 2003

(54) DOOR LOCKING SYSTEM

(76) Inventor: Avron Rosenberg, 5610 Laurel Ave., Apt. 106, Golden Valley, MN (US) 55416

( * ) Notice: Subject to any disclaimer, the term of this patent is extended or adjusted under 35 U.S.C. 154(b) by 0 days.

(21) Appl. No.: 09/927,715

(22) Filed: Aug. 10, 2001

(65) Prior Publication Data

US 2002/0046818 A1 Apr. 25, 2002

Related U.S. Application Data

(60) Provisional application No. 60/227,489, filed on Aug. 24, 2000.

(51) Int. Cl.[7] ..... E05D 15/06

(52) U.S. Cl. ..... 160/201; 160/133; 160/188; 292/DIG. 36

(58) Field of Search ..... 160/133, 188, 160/201, 290.1; 292/164, DIG. 36; 49/199, 280

(56) References Cited

U.S. PATENT DOCUMENTS 3,163,033 A * 12/1964 Boyles ..... 160/201 X
3,869,752 A * 3/1975 Klay ..... 16/128
4,494,782 A * 1/1985 Lutz ..... 292/96
4,543,748 A * 10/1985 North, Jr. ..... 49/395
4,641,458 A * 2/1987 Pilcher et al. ..... 49/20
4,921,288 A * 5/1990 Cifuentes et al. ..... 292/144
5,173,993 A * 12/1992 Baker ..... 16/329
5,246,054 A * 9/1993 Shepherd et al. ..... 160/133
5,467,558 A * 11/1995 Kober et al. ..... 49/220
5,489,130 A * 2/1996 Clark ..... 292/66
5,533,561 A * 7/1996 Forehand, IV ..... 160/188
5,673,949 A * 10/1997 Mader et al. ..... 292/164
5,706,877 A * 1/1998 Grisham et al. ..... 160/201
5,904,384 A * 5/1999 Mader et al. ..... 292/333
6,282,752 B1 * 9/2001 Kluting et al. ..... 16/334
2001/0029760 A1 * 10/2001 Viney ..... 70/279.1
2001/0047567 A1 * 12/2001 Guillemette ..... 16/353

* cited by examiner

*Primary Examiner*—Bruce A. Lev
(74) *Attorney, Agent, or Firm*—Patterson, Thuente, Skaar, & Christensen, P.A.

(57) ABSTRACT

A locking system for a roll-up door that is substantially integrated into the roll-up door so that the locking resists vandalism and damage.

18 Claims, 6 Drawing Sheets

DOOR LOCKING SYSTEM

REFERENCE TO RELATED APPLICATION

This application claims the benefit of U.S. provisional patent application Ser. No. 60/227,489, filed Aug. 24, 2000, the disclosure of which is incorporated herein by this reference.

FIELD OF THE INVENTION

The present invention relates generally to locking devices. More particularly, the present invention relates to locking devices that are particularly suited for use with roll-up doors.

BACKGROUND OF THE INVENTION

Many different types of trucks have roll-up style doors. These doors are popular because they may be readily moved between the open and closed positions. Roll-up doors are also popular because they do not interfere with loading and unloading items from the truck when in the open position.

Roll-up doors typically include a plurality of door sections that are pivotally attached to each other. The door sections are slidably mounted in tracks that are positioned on either side of the door.

Roll-up doors generally include a latching mechanism proximate a lower edge thereof to retain the roll-up door in a closed position. In some instances the latching mechanism may also be used to lock the roll-up door in the closed position.

Most latching mechanisms are attached to an outer surface of the rollup door. This configuration provides persons who desire to gain unauthorized access to items in the truck with the ability to break the latching mechanism off the roll-up door and then open the door.

It has also been attempted to mount roll-up door latching mechanisms on an inner surface of the roll-up door. While such a system provides an enhanced level of security, if the inner mounted latch fails, there is no way to open the roll-up door without damaging or removing the roll-up door. As such, this latch style has not gained wide spread approval.

SUMMARY OF THE INVENTION

The present invention is directed to a locking system for a roll-up door. The locking system includes a rear plate, a front plate, a lock mechanism, a hinge mechanism and a lock pin. The front plate is removably attached to the rear plate. The lock mechanism is attached to the rear plate. The hinge mechanism is attached to the rear plate. The hinge mechanism has a first portion, a second portion and a pin that pivotally attaches the first portion to the second portion. The lock pin at least partially extends through the pin. The lock pin is operably connected to the lock mechanism.

DETAILED DESCRIPTION OF PREFERRED EMBODIMENTS

Figure 1:
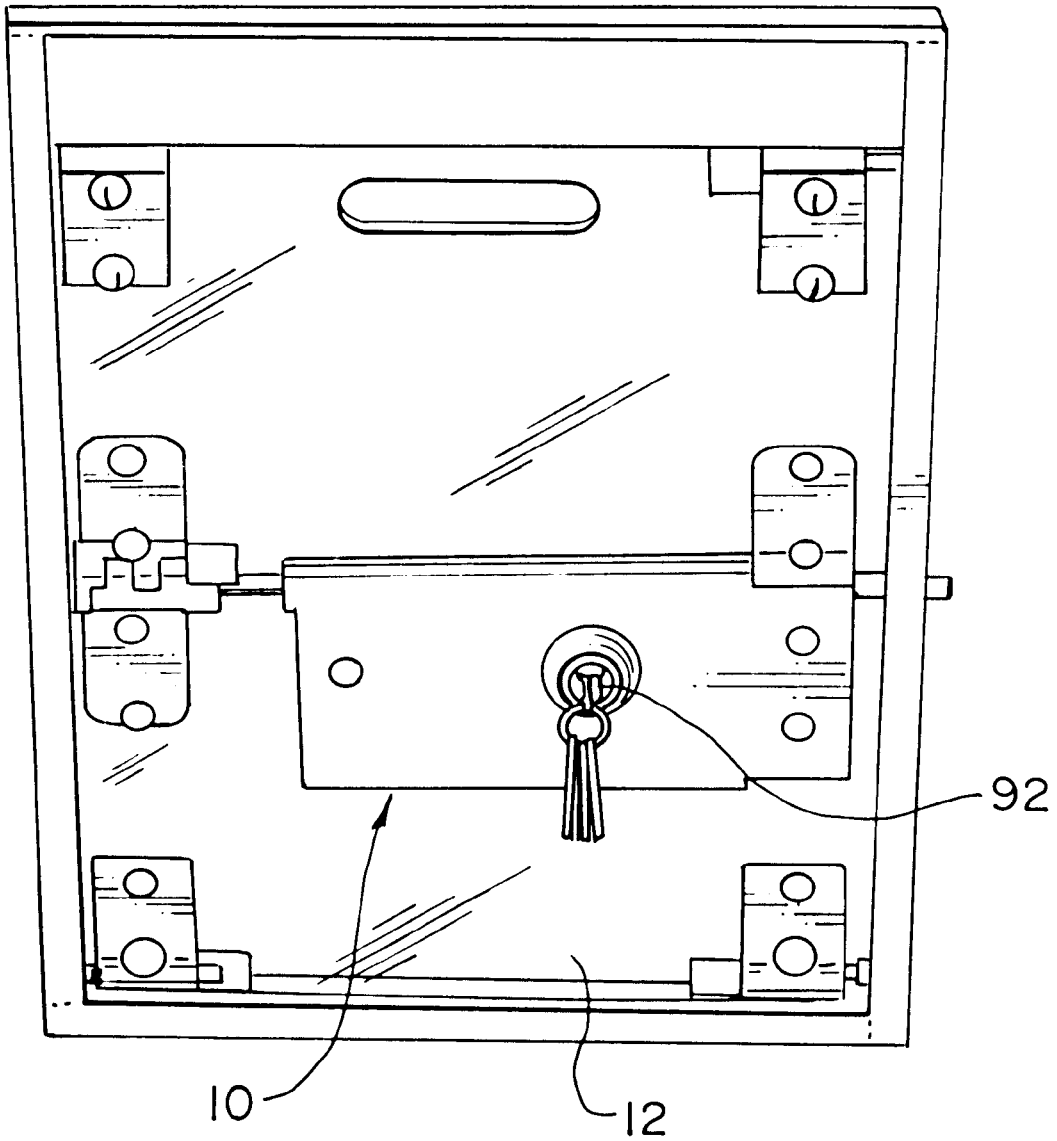
FIG. 1 is a photograph of a locking system of the present invention in a roll-up door.

A locking system of the present invention is illustrated at 10 in FIG. 1. The locking system 10 is particularly suited for use with a roll-up door 12 such as is used on delivery trucks. The locking system 10 positioned proximate the intersection of panels 14 on the roll-up door 12.

Integrating the locking system 10 into the roll-up door 12 substantially reduces the potential that the locking system 10 can be broken by persons attempting to gain unauthorized access to items stored behind the roll-up door 12. Integrating the locking system 10 into the roll-up door 12 also reduces the potential for damage to the locking system 10 caused by items contacting the inner or outer surfaces of the locking system 10.

Figure 2:
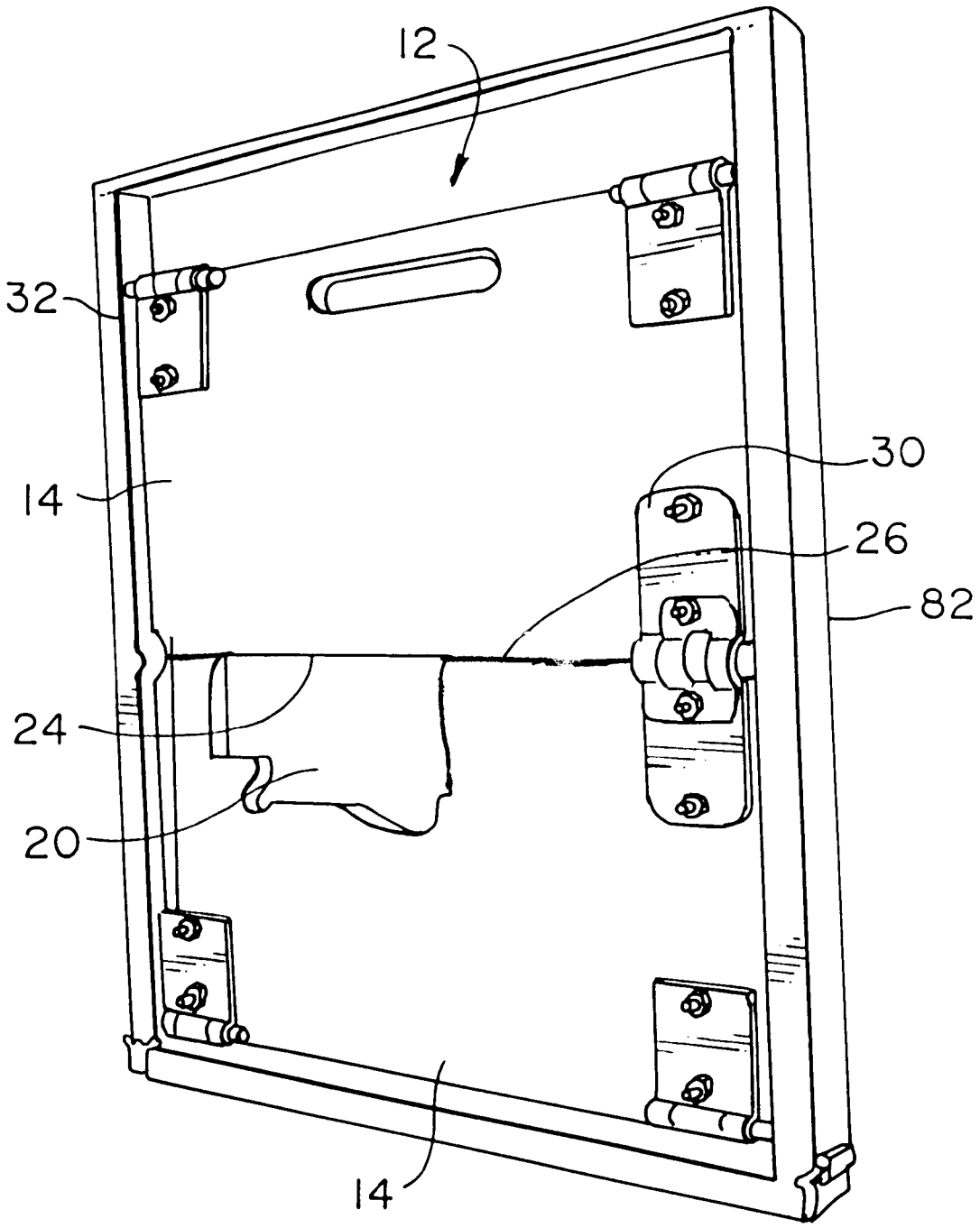
FIG. 2 is a photograph of the roll-up door with the locking system removed therefrom.

The locking system 10 is designed to seat within an aperture 20 that is formed in one of the panels 14 in the roll-up door 12, as most clearly illustrated in FIG. 2. The aperture 20 is preferably positioned along a top edge 24 or a bottom edge 26 of one of the door panels 14.

The locking system 10 is integrated with a hinge 30 that is used for attaching the door panels 14 to a track 32 that is positioned on either side of the door panels 14. The hinge 30 and the track 32 are substantially identical to the hinges and tracks used with conventional roll-up doors. This design permits the locking system 10 of the present invention to be readily added to conventional roll-up doors.

Figure 3:
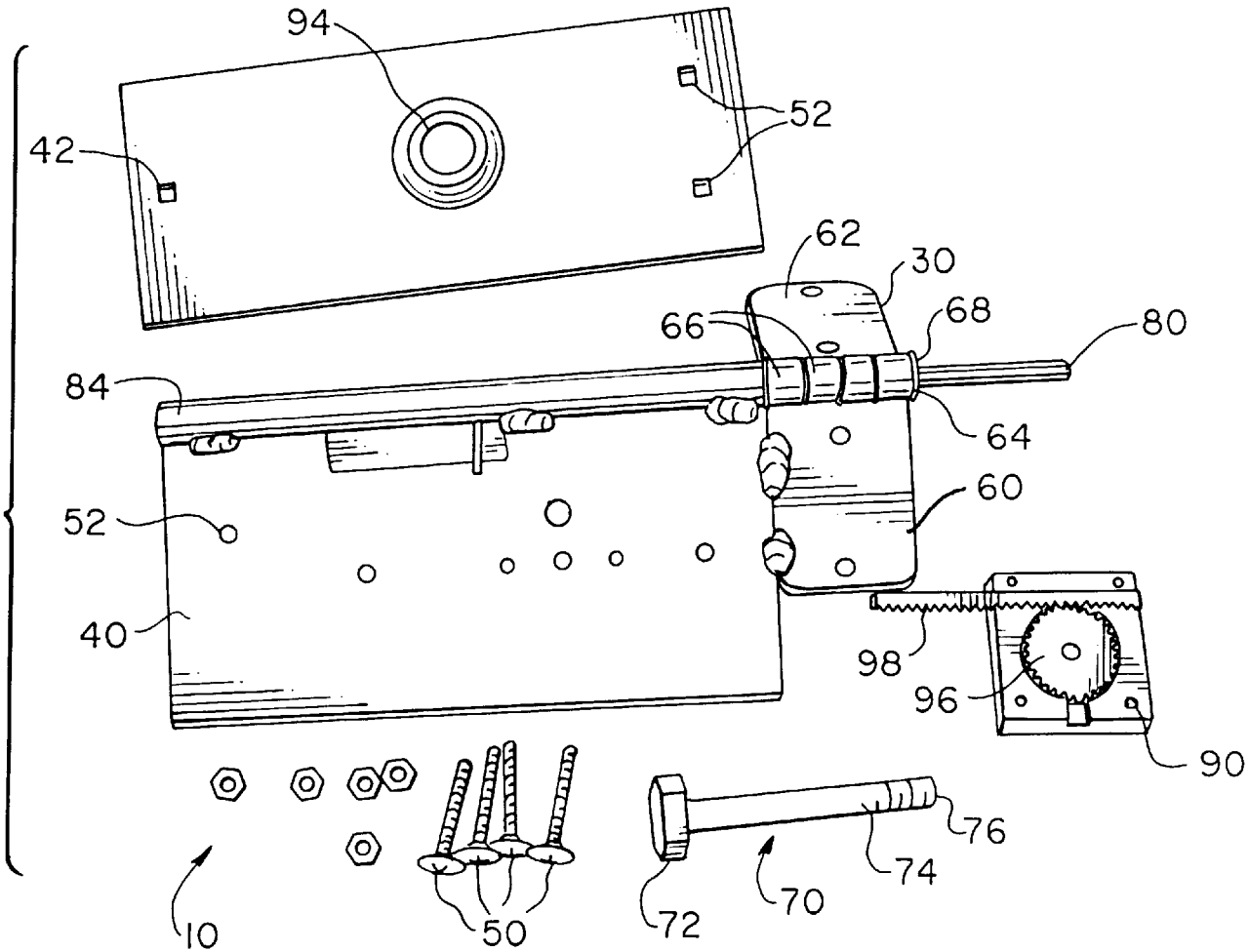
FIG. 3 is a photograph of the locking system in a substantially unassembled configuration.

The locking system 10 generally includes a back plate 40 and a front plate 42 that each preferably have a substantially rectangular configuration, as most clearly illustrated in FIG. 3. The back plate 40 and the front plate 42 are selected with a length and width that is greater than a length and width of the aperture 20 so that the locking system 10 covers the portion of the door panel 14 that is removed to make the aperture 20.

The back plate 40 is positioned along a back surface of the door panel 14 and the front plate 42 is positioned along a front surface of the door panel 14. The back plate 40 and the front plate 42 are preferably bolted together with a plurality of flat head bolts 50. The flat head bolts 50 eliminate the potential of a person removing the front plate 42 by unscrewing the bolts 50 from the outside of the roll-up door 12. The bolts 50 are extended through holes 52 formed in the back plate 40 and the front plate 42.

Figure 4:
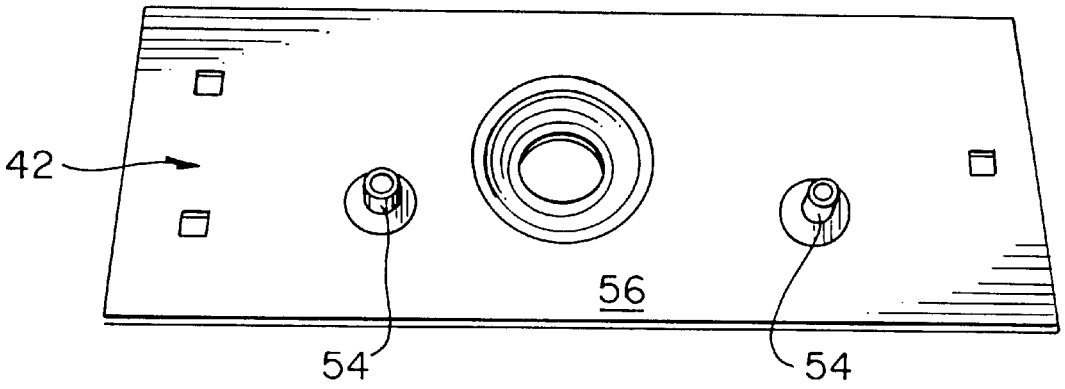
FIG. 4 is a rear view of a front plate for the locking system.

To provide an additional level of protection against removal of the front plate 42 by cutting off the heads of the bolts 50, nuts 54 are preferably welded to an inner surface 56 of the front plate 42, as most clearly illustrated in FIG. 4. Screws are extended through holes 52 on the back plate 40 to engage the nuts 54.

As noted above, the locking system 10 is preferably integrated with the hinge 30 by attaching a first hinge plate 60 to the back plate 40. A person of ordinary skill in the art will appreciate that the hinge plate 60 and the back plate 40 may be formed from a single piece of material.

The hinge 30 also includes a second hinge plate 62 that is pivotally attachable to the first hinge plate 60 by extending a hinge shaft 64 through the attachment regions 66 on the first hinge plate 60 and the second hinge plate 62, as illustrated in FIG. 3. Opposite ends 68 of the hinge shaft 64 are preferably outwardly flared to retain the hinge shaft 64 in the attachment regions 66.

The hinge shaft 64 has a central bore 69 adapted to receive a bearing assembly 70 for operably connecting the hinge 30 to the track 32. The wheel assembly 70 preferably includes a bearing 72 and a bearing shaft 74 that extends from the bearing 72.

The bearing 72 and the bearing shaft 74 both have a central bore 76 that is adapted to receive a locking pin 80. The track 32 has at least one aperture 82 formed therein that is adapted to receive an end of the locking pin 80. When the locking pin 80 extends through the aperture 82, the door is locked in a closed position.

A shaft 84 is attached to the back plate 40 so that the shaft 84 is axially aligned with the hinge shaft 64. The shaft 84 is adapted to receive the locking pin 80. Movement of the locking pin 80 in the shaft 84 is limited by a first pin 86 that extends from an intermediate position on the locking pin 80 through an opening 85 on the shaft 84. The first pin 86 is used for operably connecting the locking pin 80 to a lock mechanism 90.

The lock mechanism 90 has a key interface 92 that extends through an aperture 94 in the front plate 42 to thereby operate the locking system 10. A person of ordinary skill in the art will appreciate that it is possible to use a variety of different key styles in conjunction with the locking system 10 of the present invention. It is also possible to adapt the concepts of the present invention to provide a key interface 92 on the front and rear sides of the roll-up door 12.

Figure 5:
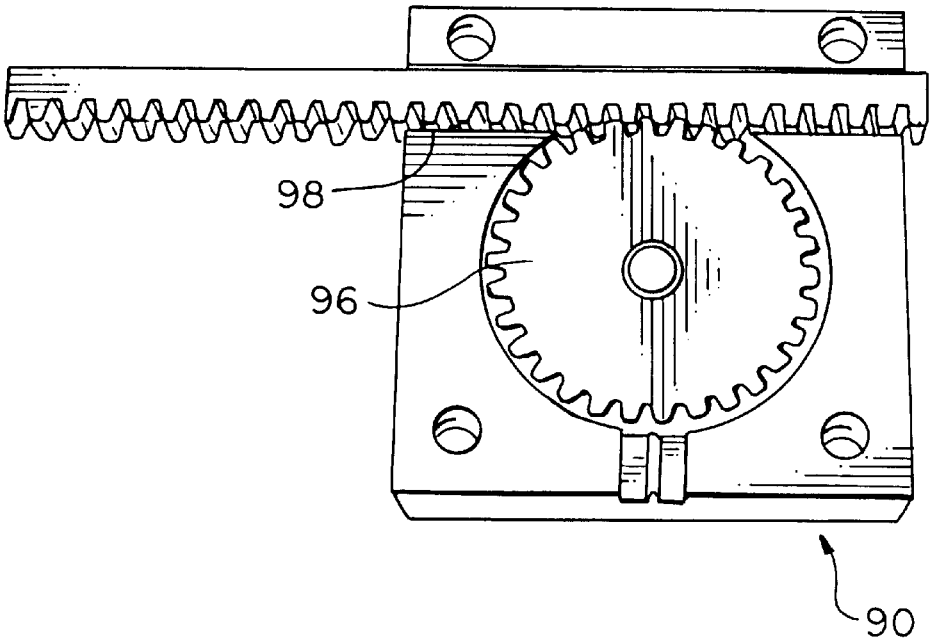
FIG. 5 is a rear view of a locking mechanism for the locking system.

The key interface 92 is operably attached to a toothed gear 96 positioned on a back side of the lock mechanism 90, as most clearly illustrated in FIG. 5. The toothed gear 96 is operably attached to a toothed rack 98. Rotation of the toothed gear 96 thereby causes the toothed rack 98 to slide with respect to the lock mechanism 90.

The lock mechanism 90 is attached to the back plate 40 so that the toothed rack 98 slides parallel to the direction in which the locking pin 80 slides in the shaft 84. Sliding of the toothed rack 98 causes the pin 86 to slide away from the hinge 30 and moves the locking system 10 from the locked position to the unlocked position.

Figure 6:
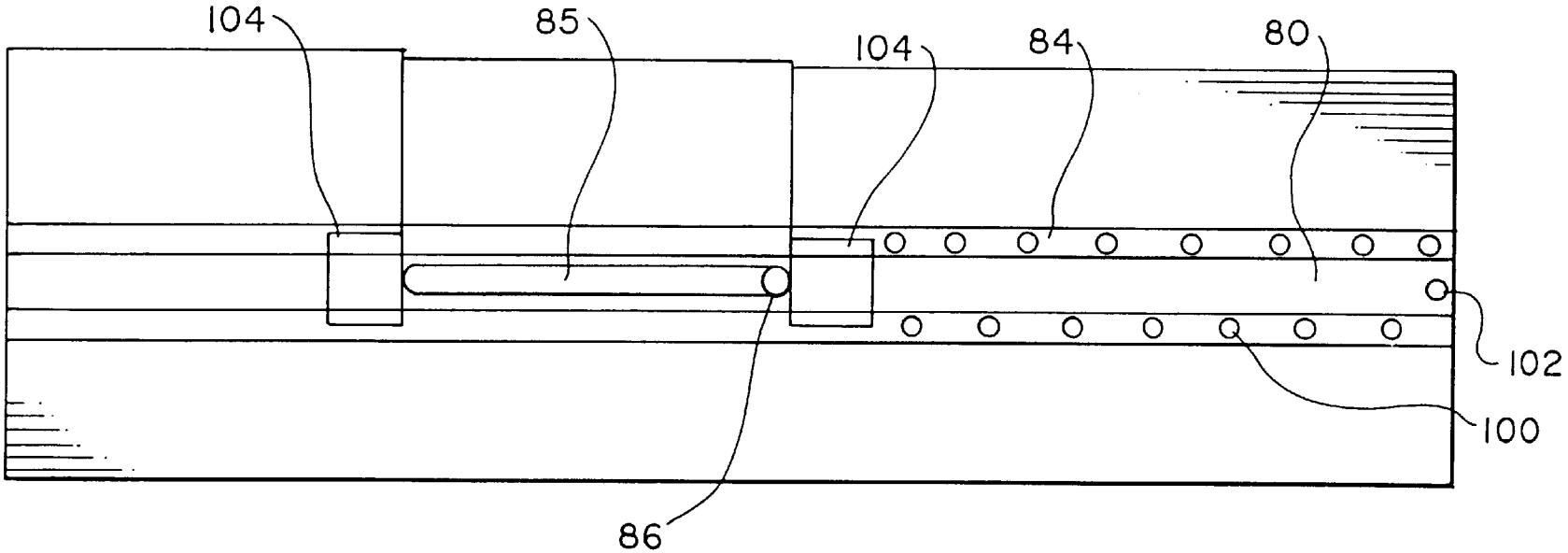
FIG. 6 is a top view of a shaft for the locking system.
Figure 7:
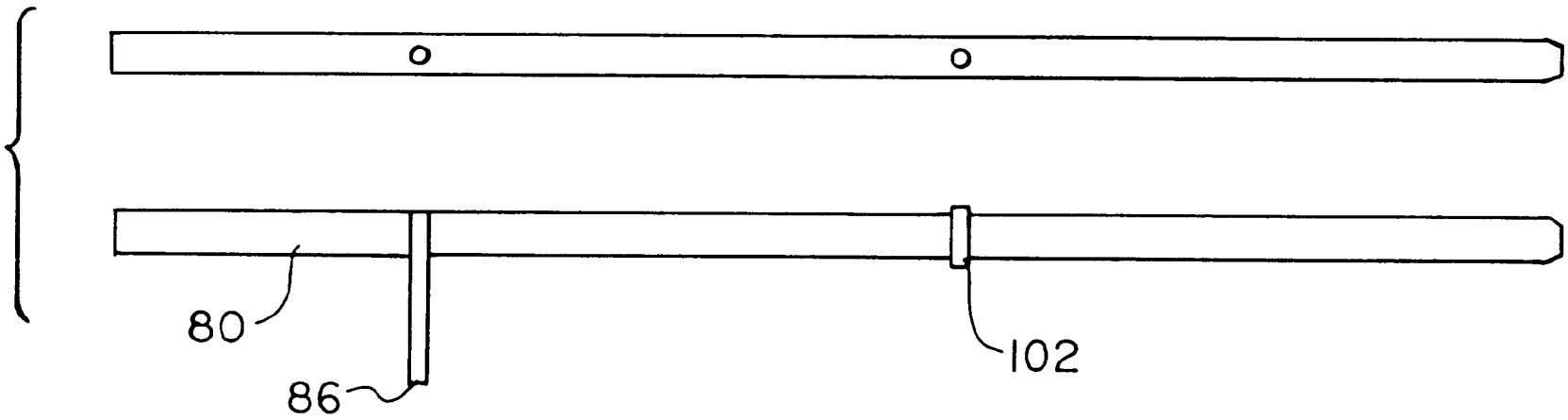
FIG. 7 is a side view of a locking pin for the locking system.

A spring 100 is positioned along the locking pin 80, as most clearly illustrated in FIG. 6. The spring 100 biases the locking pin 80 in the shaft 84 to the locked position. A first end of the spring 100 is held captive between a second pin 102 that extends through the locking pin 80 proximate the intersection of the hinge 30 and the back plate 30, as most clearly illustrated in FIG. 7. The second pin 102 also limits the distance that the bearing assembly 70 extends over the locking pin 80. A second end of the spring 100 is held captive by a bushing 104 that is placed into an end of the shaft 84 opposite the hinge 30, as most clearly illustrated in FIG. 6. An additional bushing 104 may be used proximate an end of the shaft 84 that is opposite the hinge 30 to ensure that the locking pin 80 slides along an axis that is parallel to a central axis of the shaft 84.

The back plate 40 preferably includes an aperture 110 formed therein proximate the first pin 86. The aperture 110 is formed with a length and width that permits a person to reach in the aperture 110 to move the locking pin 80 from the locked position to the open position to thereby eliminate the potential of a person becoming locked behind the roll-up door 12.

It is also possible to extend the first pin 86 out both sides of the locking pin 80 so that an end of the first pin 86 opposite the toothed rack 98 extends from the locking system 10 to facilitate moving the locking system 10 from the locked position to the unlocked position from inside the roll-up door 12. When this configuration is used, the shaft 84 has a slot (not shown) formed therein through which the second end of the first pin 86 can extend.

In operation, the spring 100 biases the locking pin 80 in a locked position where the locking pin 80 extends through the aperture 82 in the track 32. When it is desired to open the locking system 10, a key is inserted into the key interface 92 and then rotated. This rotation causes the toothed gear 96 to rotate. As the toothed gear 96 rotates, the toothed rack 98 slides away from the hinge 30 and contacts the first pin 86, which urges the locking pin 80 to move out of the aperture 82, which thereby permits the roll-up door 12 to be opened.

Because the spring 100 biases the locking pin to the locking pin 80 to the locked position, the locking pin 80 will move into the aperture 82 as the roll-up door 12 is returned to the closed position to automatically lock the roll-up door 12. The automatic nature of the locking system 10 reduces the likelihood that the roll-up door 12 will be inadvertently left unlocked.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A roll-up door comprising:

a pair of rails;

a first door panel having an aperture formed therein;

a second door panel pivotally mounted to the first door panel so that the first door panel and the second door panel move as a unit with respect to the pair of rails;

a hinge mechanism comprising:

a first hinge plate attached to the first door;

a second hinge plate attached to the second door; and a hinge pin pivotally attaching the first hinge plate to the second hinge plate;

a bearing assembly removably attached to the hinge pin, wherein the bearing assembly engages one of the rails to slidably mount the first door panel, the second door panel and the hinge mechanism with respect to the rail; and a locking system adapted to at least partially seat in the aperture, wherein the locking system extends through the hinge pin and selectively engages at least one of the rails to lock the roll-up door in a closed position.

2. The roll-up door of claim 1, wherein the locking system comprises:

a rear plate;

a front plate removably attached to the rear plate;

a lock mechanism mounted to the rear plate; and a locking pin at least partially extending through the hinge pin, wherein the locking pin is operably connected to the lock mechanism.

3. The roll-up door of claim 2, and further comprising a shaft attached to the rear plate, wherein the locking pin is slidably mounted in the shaft.

4. The roll-up door of claim 3, wherein the locking pin is biased out of the shaft.

5. The roll-up door of claim 2, wherein the lock mechanism comprises:

a key interface that is adapted to receive a key;

a toothed gear operably connected to the key interface; and a toothed plate operably connected to the toothed gear and the locking pin.

6. The roll-up door of claim 2, wherein the front plate has at least one nut mounted to a back surface thereof for use in attaching the front plate to the rear plate.

7. The roll-up door of claim 1, wherein the first door panel and the second door panel slide vertically with respect to the pair of rails.

8. A locking system for a roll-up door, the locking system comprising:

a rear plate;

a front plate removably attached to the rear plate;

a lock mechanism mounted to the rear plate, the lock mechanism comprising:

a key interface that is adapted to receive a key;

a toothed gear operably connected to the key interface; and a toothed plate operably connected to the toothed gear and the locking pin;

a hinge mechanism attached to the rear plate, wherein the hinge mechanism has a first portion, a second portion and a hinge pin that pivotally attaches the first portion to the second portion; and a locking pin at least partially extending through the hinge pin, wherein the locking pin is operably connected to the lock mechanism.

9. The roll-up door of claim 8, and further comprising a shaft attached to the rear plate, wherein the locking pin is slidably mounted in the shaft.

10. The roll-up door of claim 9, the locking pin is biased out of the shaft.

11. The roll-up door of claim 8, wherein the front plate has at least one nut mounted to a back surface thereof for use in attaching the front plate to the rear plate.

12. A method of locking a roll-up door comprising:

attaching a first hinge plate to a first door panel, wherein the first door panel has an aperture formed therein;

attaching a second hinge plate to a second door panel;

pivotally attaching the first hinge plate to the second hinge plate with a hinge pin;

slidably attaching first door panel and the second door panel to a rail with a bearing assembly, wherein the bearing assembly is removably attached to the hinge pin;

locking the first door panel and the second door panel in a stationary position with respect to the rail with a locking system, wherein the locking system at least partially seats in the aperture, and wherein the locking system extends through the hinge pin and selectively engages the rail to lock the first door panel and the second door panel in the stationary position.

13. The method of claim 12, wherein the locking system comprises a rear plate; a front plate removably attached to the rear plate; a lock mechanism mounted to the rear plate; and a locking pin at least partially extending through the hinge pin, wherein the locking pin is operably connected to the lock mechanism.

14. The method of claim 13, and further comprising attaching a shaft to the rear plate, wherein the locking pin is slidably mounted in the shaft.

15. The method of claim 14, and further comprising biasing the locking pin out of the shaft.

16. The method of claim 13, wherein the lock mechanism comprises a key interface that is adapted to receive a key; a toothed gear operably connected to the key interface; and a toothed plate operably connected to the toothed gear and the locking pin.

17. The method of claim 13, and further comprising mounting at least one nut mounted to a back surface of the front plate, wherein the at least one nut is used in attaching the front plate to the rear plate.

18. The method of claim 12, wherein the first door panel and the second door panel slide vertically with respect to rail.

* * * * *